US008085233B2

(12) United States Patent
Lu et al.

(10) Patent No.: US 8,085,233 B2
(45) Date of Patent: Dec. 27, 2011

(54) PIXEL DRIVING METHOD, PIXEL DRIVING CIRCUIT FOR PERFORMING THE SAME, AND DISPLAY APPARATUS HAVING THE PIXEL DRIVING CIRCUIT

(75) Inventors: Jian Gang Lu, Suwon-si (KR); Hong-Jo Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 483 days.

(21) Appl. No.: 12/412,185

(22) Filed: Mar. 26, 2009

(65) Prior Publication Data

US 2009/0289887 A1 Nov. 26, 2009

(30) Foreign Application Priority Data

May 20, 2008 (KR) ..... 10-2008-0046541

(51) Int. Cl.
*G09G 3/36* (2006.01)

(52) U.S. Cl. ..... 345/98; 345/87

(58) Field of Classification Search ..... 345/82–102, 345/204
See application file for complete search history.

(56) References Cited

U.S. PATENT DOCUMENTS

| | | | | |
|---|---|---|---|---|
| 7,286,108 | B2 * | 10/2007 | Tsuda et al. | 345/92 |
| 7,319,444 | B2 * | 1/2008 | Jo | 345/76 |
| 7,321,353 | B2 * | 1/2008 | Tsuda et al. | 345/99 |
| 7,339,570 | B2 * | 3/2008 | Kubota et al. | 345/98 |
| 7,355,571 | B2 * | 4/2008 | Yamada et al. | 345/76 |
| 7,355,580 | B2 * | 4/2008 | Shen et al. | 345/98 |
| 7,859,491 | B2 * | 12/2010 | Lee et al. | 345/76 |
| 7,920,113 | B2 * | 4/2011 | Um et al. | 345/87 |
| 2008/0180370 | A1 * | 7/2008 | Huang et al. | 345/87 |
| 2009/0096727 | A1 * | 4/2009 | Kimura | 345/84 |
| 2009/0219237 | A1 * | 9/2009 | Yamazaki | 345/84 |
| 2009/0262056 | A1 * | 10/2009 | Yang et al. | 345/89 |
| 2009/0262100 | A1 * | 10/2009 | Su et al. | 345/209 |
| 2009/0289887 | A1 * | 11/2009 | Lu et al. | 345/98 |
| 2011/0096046 | A1 * | 4/2011 | Yamashita et al. | 345/204 |

* cited by examiner

*Primary Examiner* — Nitin Patel
(74) *Attorney, Agent, or Firm* — H.C. Park & Associates, PLC

(57) ABSTRACT

A pixel driving circuit includes a first gate line, a second gate line, a first data line, a second data line, a pixel part, a first driving part, a second driving part, and a first voltage-changing part. The first driving part applies a first data voltage to the first pixel electrode. The second driving part applies a second data voltage to the second pixel electrode. The first voltage-changing part is connected to the first pixel electrode, the first data line, and the second data line to change a first pixel voltage of the first pixel electrode to increase a voltage difference between the first and second pixel electrodes.

22 Claims, 9 Drawing Sheets

PIXEL DRIVING METHOD, PIXEL DRIVING CIRCUIT FOR PERFORMING THE SAME, AND DISPLAY APPARATUS HAVING THE PIXEL DRIVING CIRCUIT

CROSS REFERENCE TO RELATED APPLICATION

This application claims priority from and the benefit of Korean Patent Application No. 10-2008-0046541, filed on May 20, 2008, which is hereby incorporated by reference for all purposes as if fully set forth herein.

BACKGROUND OF THE INVENTION

1. Field of the Invention

The present invention relates to a pixel driving method, a pixel driving circuit for performing the pixel driving method, and a display apparatus having the pixel driving circuit. More particularly, the present invention relates to a pixel driving method employed in a liquid crystal display (LCD) apparatus, a pixel driving circuit for performing the pixel driving method, and a display apparatus having the pixel driving circuit.

2. Discussion of the Background

A liquid crystal display (LCD) apparatus includes a first substrate, a second substrate facing the first substrate, and a liquid crystal layer disposed between the first and second substrates. The first substrate includes a plurality of signal lines, a plurality of thin-film transistors (TFTs) connected to the signal lines, and a pixel part connected to the TFTs.

The pixel part may include first and second pixel electrodes spaced apart from each other on the same plane and formed within a unit pixel. A first pixel voltage is applied to the first pixel electrode, and a second pixel voltage, which is different from the first pixel voltage, is applied to the second pixel electrode. An electric field formed between the first and second pixel electrodes may alter an arrangement of liquid crystal molecules of the liquid crystal layer, so that the LCD apparatus may display images.

In order for the LCD apparatus to realize a natural moving image, the response time of liquid crystal molecules should be enhanced. That is, an arrangement of the liquid crystal molecules should be altered more quickly. Generally, as the amplitude of the electric field formed by a voltage difference between the first and second pixel voltages increases, the response time of liquid crystal molecules is enhanced. Thus, in order to enhance the response time of liquid crystal molecules, a voltage difference between the first and second pixel voltages should be increased.

The first and second pixel voltages are determined by first and second data voltages that are applied to the first and second pixel electrodes, respectively, so that a voltage difference between the first and second data voltages may determine the response time of liquid crystal molecules.

However, the first and second data voltages are generated by a voltage-generating apparatus that outputs voltages within a limited range, so it may be impossible to increase a voltage difference between the first and second data voltages to a satisfactory level using the limited range of the apparatus. That is, it may be necessary to modify the voltage-generating apparatus itself to increase a voltage difference between the first and second data voltages.

SUMMARY OF THE INVENTION

The present invention provides a pixel driving method in which a voltage difference between a first pixel voltage and a second pixel voltage may be increased.

The present invention also provides a pixel driving circuit suitable for the above-mentioned method.

The present invention also provides a display apparatus having the pixel driving circuit.

Additional features of the invention will be set forth in the description which follows, and in part will be apparent from the description, or may be learned by practice of the invention.

The present invention discloses a pixel driving method including applying a first data voltage and a second data voltage to a first pixel electrode and a second pixel electrode, respectively, that are spaced apart from each other. The first and second data voltages are stored in a plurality of capacitors that are connected to the first pixel electrode or the second pixel electrode, when a first gate signal is applied to a first gate line. Then, a first pixel voltage of the first pixel electrode or a second pixel voltage of the second pixel electrode is changed to increase a voltage difference between the first and second pixel electrodes by mixing between the first and second data voltages stored in the capacitors, when a second gate signal is applied to a second gate line adjacent to the first gate line.

The present invention also discloses a pixel driving circuit including a first gate line, a second gate line, a first data line, a second data line, a pixel part, a first driving part, a second driving part, and a first voltage-changing part. The first and second gate lines extend along a first direction and are disposed adjacent to each other. The first data line extends along a second direction crossing the first direction. The first data line transmits a first data voltage. The second data line is disposed adjacent to the first data line. The second data line transmits a second data voltage that is different from the first data voltage. The pixel part is disposed within a unit pixel. The pixel part includes a first pixel electrode and a second pixel electrode that are spaced apart from each other. The first driving part is connected to the first data line and the first pixel electrode. The first driving part applies the first data voltage to the first pixel electrode. The second driving part is connected to the second data line and the second pixel electrode. The second driving part applies the second data voltage to the second pixel electrode. The first voltage-changing part is connected to the first pixel electrode, the first data line, and the second data line. The first voltage-changing part changes a first pixel voltage of the first pixel electrode to increase a voltage difference between the first and second pixel electrodes.

The present invention also discloses a display apparatus including a first substrate, a second substrate, and a liquid crystal layer. The first substrate has a pixel driving circuit disposed on a base substrate. The second substrate faces the first substrate. The liquid crystal layer is disposed between the first and second substrates. The pixel driving circuit includes a first gate line, a second gate line, a first data line, a second data line, a pixel part, a first driving part, a second driving part, and a first voltage-changing part. The first and second gate lines extend along a first direction and are disposed adjacent to each other. The first data line extends along a second direction crossing the first direction. The first data line transmits a first data voltage. The second data line is disposed adjacent to the first data line. The second data line transmits a second data voltage that is different from the first data voltage. The pixel part is disposed within a unit pixel. The pixel part includes a first pixel electrode and a second pixel electrode that are spaced apart from each other. The first driving part is connected to the first data line and the first pixel electrode. The first driving part applies the first data voltage to the first pixel electrode. The second driving part is connected to the second data line and the second pixel electrode. The second driving part applies the second data voltage to the second pixel electrode. The first voltage-changing part is connected to the first pixel electrode, the first data line, and the second data line. The first voltage-changing part changes a first pixel voltage of the first pixel electrode to increase a voltage difference between the first and second pixel electrodes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
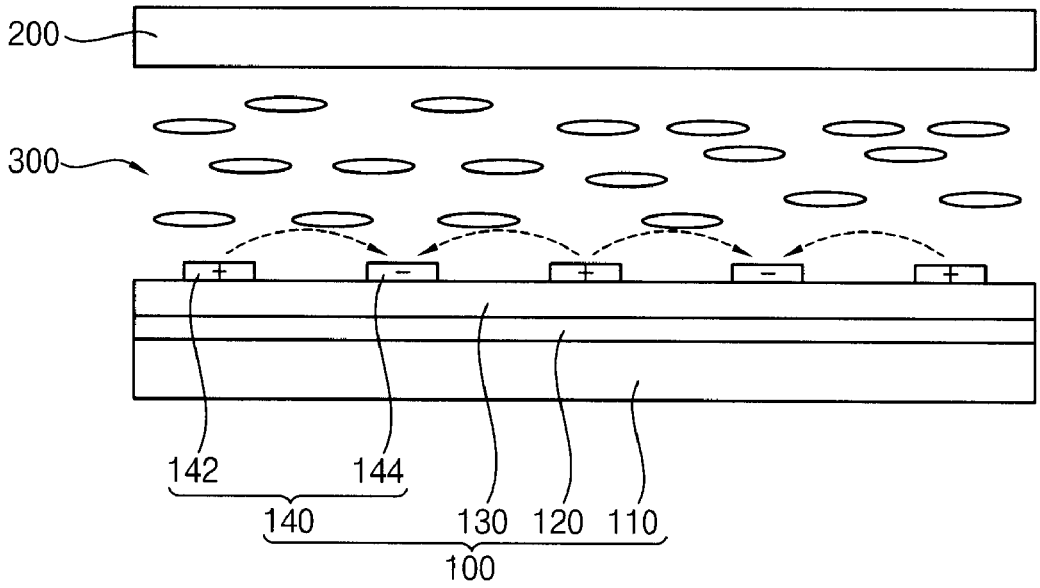
FIG. 1 is a cross-sectional view showing a display apparatus according to Exemplary Embodiment 1 of the present invention.

The present invention is described more fully hereinafter with reference to the accompanying drawings, in which example embodiments of the present invention are shown. The present invention may, however, be embodied in many different forms and should not be construed as limited to the example embodiments set forth herein. Rather, these exemplary embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to," or "coupled to" another element or layer, it can be directly on, connected to, or coupled to the other element or layer or intervening elements or layers may be present. In contrast, when an element is referred to as being "directly on," "directly connected to," or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer or section from another region, layer or section.

Spatially relative terms, such as "beneath," "below," "lower," "above," "upper," and the like, may be used herein for ease of description to describe one element or feature's relationship to another element(s) or feature(s) as shown in the figures. It will be understood that the spatially relative terms are intended to encompass different orientations of the apparatus in use or operation in addition to the orientation depicted in the figures. For example, if the apparatus in the figures is turned over, elements described as "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Exemplary embodiments of the invention are described herein with reference to cross-sectional illustrations that are schematic illustrations of idealized exemplary embodiments (and intermediate structures) of the present invention. As such, variations from the shapes of the illustrations as a result, for example, of manufacturing techniques and/or tolerances, are to be expected. Thus, exemplary embodiments of the present invention should not be construed as limited to the particular shapes of regions illustrated herein but are to include deviations in shapes that result, for example, from manufacturing. For example, an implanted region shown as a rectangle may have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions shown in the figures are schematic in nature and their shapes are not intended to show the actual shape of a region of an apparatus and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the present invention will be explained in detail with reference to the accompanying drawings.

Exemplary Embodiment 1

FIG. 1 is a cross-sectional view showing a display apparatus according to Exemplary Embodiment 1 of the present invention.

Referring to FIG. 1, a display apparatus according to the present exemplary embodiment includes a first substrate 100, a second substrate 200 facing the first substrate 100, and a liquid crystal layer 300 disposed between the first and second substrates 100 and 200.

The first substrate 100 may include a base substrate 110, a common electrode 120, an insulation layer 130, and a pixel part 140. The base substrate 110 may have a flat shape. The base substrate 110 may include an optically transparent material such as glass, quartz, or plastic. The common electrode 120 is formed on the base substrate 110 to receive a common voltage from an external device. The insulation layer 130 is formed on the common electrode 120. The insulation layer 130 may be an organic insulation layer or an inorganic insulation layer.

The pixel part 140 is formed on the insulation layer 130. The pixel part 140 includes a first pixel electrode 142 and a second pixel electrode 144 that is spaced apart from the first pixel electrode 142. The pixel part 140 may be formed from a transparent electrode layer through a patterning process.

The first and second pixel electrodes 142 and 144 may each have a comb shape that is disposed in a zigzag pattern. For example, the first pixel electrode 142 may include a plurality of comb electrode patterns disposed parallel to each other, and the second pixel electrode 144 may include a plurality of comb electrode patterns disposed parallel to each other. Here, the first and second comb electrode patterns are disposed in a zigzag pattern.

The first and second pixel electrodes 142 and 144 may receive voltages having different polarities with respect to a common voltage that is applied to the common electrode. For example, a voltage having positive polarity may be applied to the first pixel electrode 142, and a voltage having negative polarity may be applied to the second pixel electrode 144. Thus, an electric field may be formed between the first and second pixel electrodes 142 and 144, which may alter the arrangement of liquid crystal molecules of the liquid crystal layer 300.

In this exemplary embodiment, the first substrate 100 may include a first alignment layer (not shown) formed on the insulation layer 130 to cover the pixel part 140, and the second substrate 200 may include a second alignment layer (not shown) facing the first alignment layer. The first and second alignment layers may align liquid crystal molecules of the liquid crystal layer 300 in a specific direction.

Alternatively, the first and second alignment layers may be omitted from this exemplary embodiment, so that a cell gap between the first and second substrates 100 and 200 may be increased. Moreover, in order to enhance the response time of the liquid crystal molecules, ultraviolet (UV) rays may be irradiated onto the first and second alignment layers.

The display apparatus may further include a backlight assembly (not shown) disposed below the first substrate 100 to provide the first substrate 100 with light.

In this embodiment, the base substrate 110 of the first substrate 100 and the second substrate 200 may have flexible characteristics. Here, a liquid crystal layer 300 interposed between the first and second substrates 100 and 200 may have blue phase liquid crystal. The blue phase liquid crystal has the different characteristics from a conventional nematic liquid crystal. That is, in the display device having the blue phase liquid crystal, an alignment layer does not required, so that a process forming the alignment layer may be omitted. That is, in the blue phase liquid crystal, so called a nano-domain having alignment having itself is formed not a retardation is formed by controlling a director of liquid crystal.

In the display device having the blue phase liquid crystal, the blue phase liquid crystal may be filled into the display device through a roll-to-roll proves, a roll printing process, a spin coating process, a vacuum filing process, an one-drop filling (ODF) process, etc.

Moreover, in the display having the blue liquid crystal, in order to form required flexible display device, a display panel is transformed, and then ultraviolet (UV) rays may be irradiated onto the transformed display panel so that a stable display device may be formed.

Figure 2:
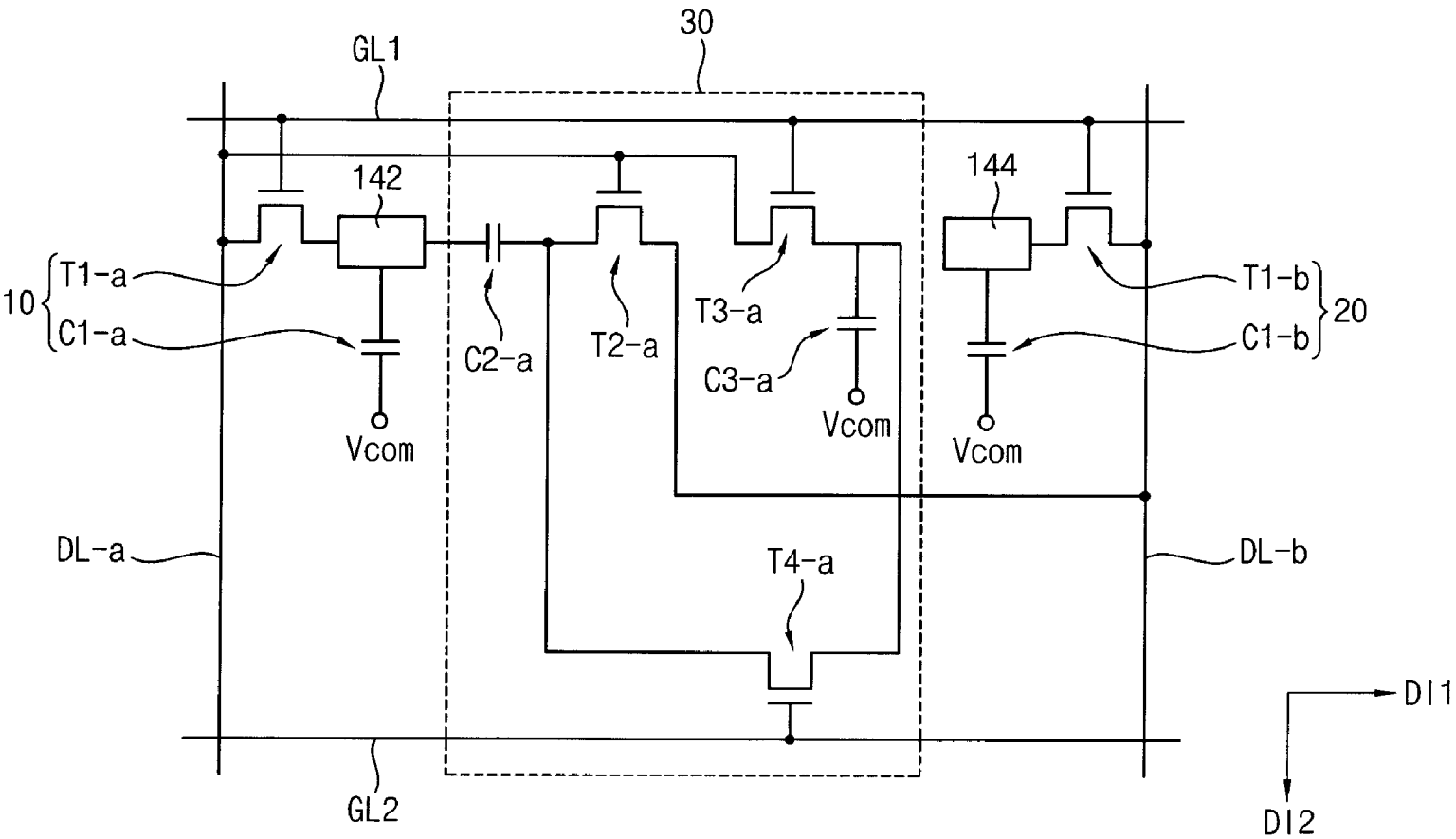
FIG. 2 is a circuit diagram showing a pixel driving circuit of the display apparatus of FIG. 1.

FIG. 2 is a circuit diagram showing a pixel driving circuit of the display apparatus of FIG. 1.

Referring to FIG. 1 and FIG. 2, the first substrate 100 includes a pixel driving circuit formed on the base substrate 110 to drive the unit pixel.

The pixel driving circuit includes first and second gate lines GL1 and GL2, first and second data lines DL-a and DL-b, a first driving part 10, a second driving part 20, and a first voltage-changing part 30. Moreover, the pixel driving circuit may further include the pixel part 140 and the common electrode 120 as shown in FIG. 1 and FIG. 2.

The first gate line GL1 extends along a first direction DI1, and the second gate line GL2 extends along the first direction DI1 to be adjacent to the first gate line GL1. Here, a first gate signal may be applied to the first gate line GL1, and then a second gate signal may be applied to the second gate line GL2.

The first data line DL-a extends along a second direction DI2 crossing the first direction DI1, and the second data line DL-b extends along the second direction DI2 and is disposed adjacent to the first data line DL-a. Here, the first and second directions DI1 and DI2 may be perpendicular to each other.

The first data line DL-a transmits a first data voltage, and the second data line DL-b transmits a second data voltage. The first and second data voltages may have the different polarities with respect to the common voltage Vcom, which is applied to the common electrode 120. For example, when the first data voltage has positive polarity, the second data voltage may have negative polarity.

The first driving part 10 is connected to the first data line DL-a and the first pixel electrode 142 to apply the first data voltage to the first pixel electrode 142. The first driving part 10 may include a first driving transistor T1-*a* and a first driving capacitor C1-*a*.

A gate electrode of the first driving transistor T1-*a* is connected to the first gate line GL1, and a source electrode of the first driving transistor T1-*a* is connected to the first data line DL-a. A drain electrode of the first driving transistor T1-*a* is connected to the first pixel electrode 142. Here, the first driving transistor T1-*a* is turned on when the first gate signal is applied to the first gate line GL1, so that the first data voltage may be applied to the first pixel electrode 142.

A first electrode of the first driving capacitor C1-*a* is connected to the first pixel electrode 142, and a second electrode of the first driving capacitor C1-*a*, which faces the first electrode, receives the common voltage Vcom from the common electrode 120. The first driving capacitor C1-*a* may maintain a first pixel voltage formed at the first pixel electrode 142.

The second driving part 20 is connected to the second data line DL-b and the second pixel electrode 144 to apply the second data voltage to the second pixel electrode 144. The second driving part 20 may include a second driving transistor T1-*b* and a second driving capacitor C1-*b*.

A gate electrode of the second driving transistor T1-*b* is connected to the first gate line GL1, and a source electrode of the second driving transistor T1-*b* is connected to the second data line DL-b. A drain electrode of the second driving transistor T1-*b* is connected to the second pixel electrode 144. Here, the second driving transistor T1-*b* is turned on when the first gate signal is applied to the first gate line GL1, so that the second data voltage may be applied to the second pixel electrode 144.

A first electrode of the second driving capacitor C1-*b* is connected to the second pixel electrode 144, and a second electrode of the second driving capacitor C-b, which faces the first electrode, receives the common voltage Vcom from the common electrode 120. The second driving capacitor C-1*b* may maintain a voltage formed at the second pixel electrode 144.

The first voltage-changing part 30 is connected to the first pixel electrode 142, the first data line DL-a, and the second data line DL-b, so that the first voltage-changing part 30 may change the first pixel voltage of the first pixel electrode 142 to increase a voltage difference between the first and second pixel electrodes 142 and 144.

For example, the first voltage-changing part 30 may include a first voltage-supplying transistor T2-*a*, a first voltage-changing capacitor C2-*a*, a first voltage-storing transistor T3-*a*, a first voltage-storing capacitor C3-*a*, and a first voltage-changing transistor T4-*a*.

A gate electrode of the first voltage-supplying transistor T2-*a* is connected to the first gate line GL1, and a source electrode of the first voltage-supplying transistor T2-*a* is connected to the second data line DL-b.

A first electrode of the first voltage-changing capacitor C2-*a* is connected to the first pixel electrode 142, and a second electrode of the first voltage-changing capacitor C2-*a*, which faces the first electrode, is connected to a drain electrode of the first voltage-supplying transistor T2-*a*.

A gate electrode of the first voltage-storing transistor T3-*a* is connected to the first gate line GL1, and a source electrode of the first voltage-storing transistor T3-*a* is connected to the first data line DL-a.

A first electrode of the first voltage-storing capacitor C3-*a* is connected to a drain electrode of the first voltage-storing transistor T3-*a*. A second electrode of the first voltage-storing capacitor C3-*a*, which faces the first electrode of the first voltage-storing capacitor C3-*a*, receives the common voltage Vcom from the common electrode 120.

A gate electrode of the first voltage-changing transistor T4-*a* is connected to the second gate line GL2, and a source electrode of the first voltage-changing transistor T4-*a* is connected to a first electrode of the first voltage-storing capacitor C3-*a*. A drain electrode of the first voltage-changing transistor T4-*a* is connected to a second electrode of the first voltage-changing capacitor C2-*a*.

Hereinafter, a method of driving the pixel driving circuit of FIG. 2 will be described.

Figure 3:
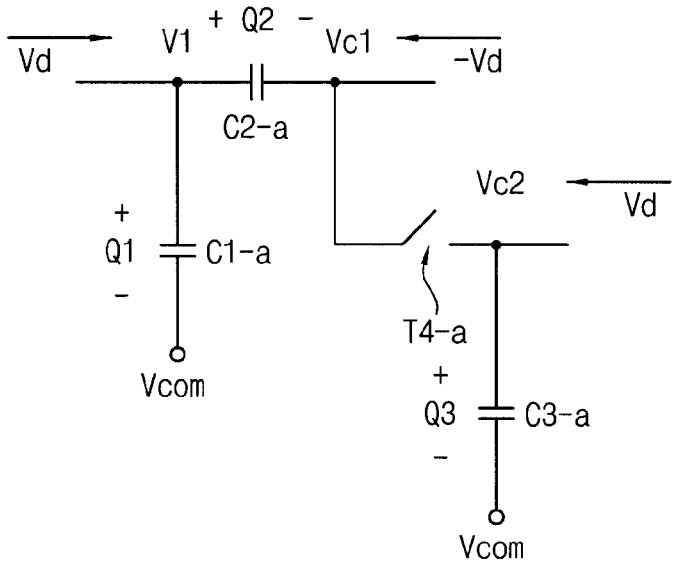
FIG. 3 is a circuit diagram schematically showing the state of a first driving part and a first voltage-changing part when a first gate signal is applied to a first gate line of FIG. 2.

FIG. 3 is a circuit diagram schematically showing the state of a first driving part and a first voltage-changing part when a first gate signal is applied to a first gate line of FIG. 2.

Referring to FIG. 2 and FIG. 3, when the first gate signal is applied to the first gate line GL1, the first driving transistor T1-*a*, the first voltage-supplying transistor T2-*a*, and the first voltage-storing transistor T3-*a* are turned on.

In this exemplary embodiment, the first data voltage may be a positive driving voltage Vd, and the second data voltage may be a negative driving voltage −Vd. When the first driving transistor T1-*a* is turned on, the positive driving voltage Vd is applied to the first pixel electrode 142. When the first voltage-supplying transistor T2-*a* is turned on, the negative driving voltage −Vd is applied to a second electrode of the first voltage-changing capacitor C2-*a*. When the first voltage-storing transistor T3-*a* is turned on, the positive driving voltage Vd is applied to a first electrode of the first voltage-storing capacitor C3-*a*.

That is, when the first gate signal is applied to the first gate line GL1, a first pixel voltage V1 of the first pixel electrode 142 is the positive driving voltage Vd, a first charge voltage Vc1 of a second electrode of the first voltage-changing capacitor C2-*a* is the negative driving voltage −Vd, and a second charge voltage Vc2 of a first electrode of the first voltage-storing capacitor C3-*a* is the positive driving voltage Vd.

Moreover, when the first gate signal is applied to the first gate line GL1, a first electric charge amount Q1 is charged in the first driving capacitor C1-*a*, and a second electric charge amount Q2 is charged in the first voltage-changing capacitor C2-*a*. Moreover, a third electric charge amount Q3 is charged in the first voltage-storing capacitor C3-*a*.

Here, when each of the first driving capacitors C1-*a*, the first voltage-changing capacitor C2-*a* and the first voltage-storing capacitor C3-*a* has a first capacitance C1, a second capacitance C2, and a third capacitance C3, respectively, the first, second, and third electric charge amounts Q1, Q2, and Q3 may be obtained by the following Equation 1.

$$Q1=C1\times V1$$

$$Q2=C2\times(V1-Vc1)$$

$$Q3=C3\times Vc2 \qquad \text{Equation 1}$$

When the first gate signal is applied to the first gate line GL1, the second driving transistor T1-*b* is also turned on. When the second driving transistor T1-*b* is turned on, the second data voltage is applied to the second pixel electrode 144. That is, a second pixel voltage of the second pixel electrode 144 is the negative driving voltage −Vd.

As a result, when the first gate signal is applied to the first gate line GL1, a voltage difference between the first and second pixel voltages may be substantially equal to a voltage difference between the first and second data voltages. That is, the voltage difference between the first and second pixel voltages may be twice the driving voltage Vd.

Figure 4:
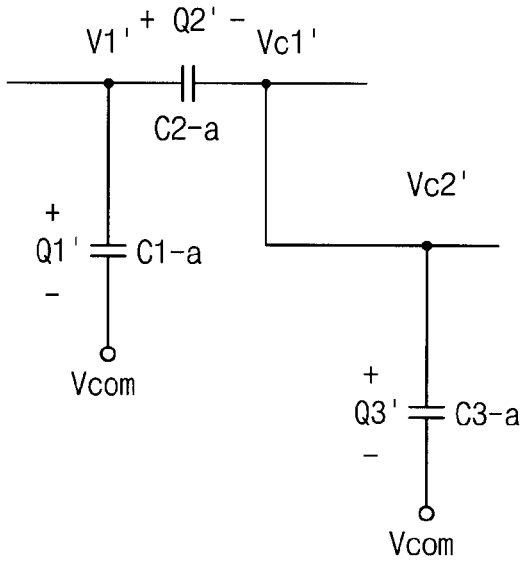
FIG. 4 is a circuit diagram schematically showing the state of a first driving part and a first voltage-changing part when a first gate signal is applied to a second gate line of FIG. 2.

FIG. 4 is a circuit diagram schematically showing the state of a first driving part and a first voltage-changing part when a first gate signal is applied to a second gate line of FIG. 2.

Referring to FIG. 2 and FIG. 4, when the second gate signal is applied to the second gate line GL2, the first voltage-changing transistor T4-*a* is turned on.

When the first voltage-changing transistor T4-*a* is turned on, the first charge voltage Vc1 of a second electrode of the first voltage-changing capacitor C2-*a* and the second charge voltage Vc2 of a first electrode of the first voltage-storing capacitor C3-*a* are mixed with each other to be changed into a medium voltage between the first and second charge voltages Vc1 and Vc2.

That is, the first charge voltage Vc1 may be increased by a voltage difference between the first charge voltage Vc1 and the medium voltage, and the second charge voltage Vc2 may be decreased by a voltage difference between the second charge voltage Vc2 and the medium voltage. Here, the changed first and second charge voltages Vc1' and Vc2' are the medium voltage between the first and second charge voltages Vc1 and Vc2.

When the first charge voltage Vc1 is increased, the first pixel voltage V1 of the first pixel electrode 142 may be increased by an increasing level of the first charge voltage Vc1. Thus, the changed first pixel voltage V1' may be greater than the positive driving voltage Vd.

Even though the second gate signal is applied to the second gate line GL2, the second pixel voltage charged in the second pixel electrode 144 may be the negative driving voltage −Vd. Accordingly, a voltage difference between the first and second pixel voltages after the second gate signal is applied may be greater than a voltage difference between the first and second pixel voltages before the second gate signal is applied. That is, a voltage difference between the first and second pixel voltages after the second gate signal is applied may be greater than a voltage difference between the first and second data voltages.

When the second gate signal is applied to the second gate line GL2, the first, second, and third electric charge amounts Q1, Q2, and Q3 that are charged in the first driving capacitor C1-*a*, the first voltage-changing capacitor C2-*a*, and the first voltage-storing capacitor C3-*a*, respectively, change. The changed first, second, and third electric charge amounts Q1', Q2', and Q3' may be obtained by the following Equation 2.

$$Q1'=C1\times V1$$

$$Q2+=C2\times(V1'-Vc1')$$

$$Q3'=C3\times Vc2' \qquad \text{Equation 2}$$

Referring again to FIG. 3 and FIG. 4, the quantity of electric charge, which is formed within each capacitor due to the conservation law of electrical charge, may be obtained by the following Equation 3.

$$Q1+Q2=Q1'+Q2'$$

$$Q3-Q2=Q3'-Q2' \qquad \text{Equation 3}$$

When the changed first pixel voltage V1' is calculated using Equations 1, 2, and 3, the following Equation 4 may be obtained.

$$V1' = (1+K)\times Vd, \text{ wherein } K = \frac{\frac{2}{C2}}{\left(\frac{1}{C1}+\frac{1}{C2}+\frac{1}{C3}\right)} \qquad \text{Equation 4}$$

Figure 5:
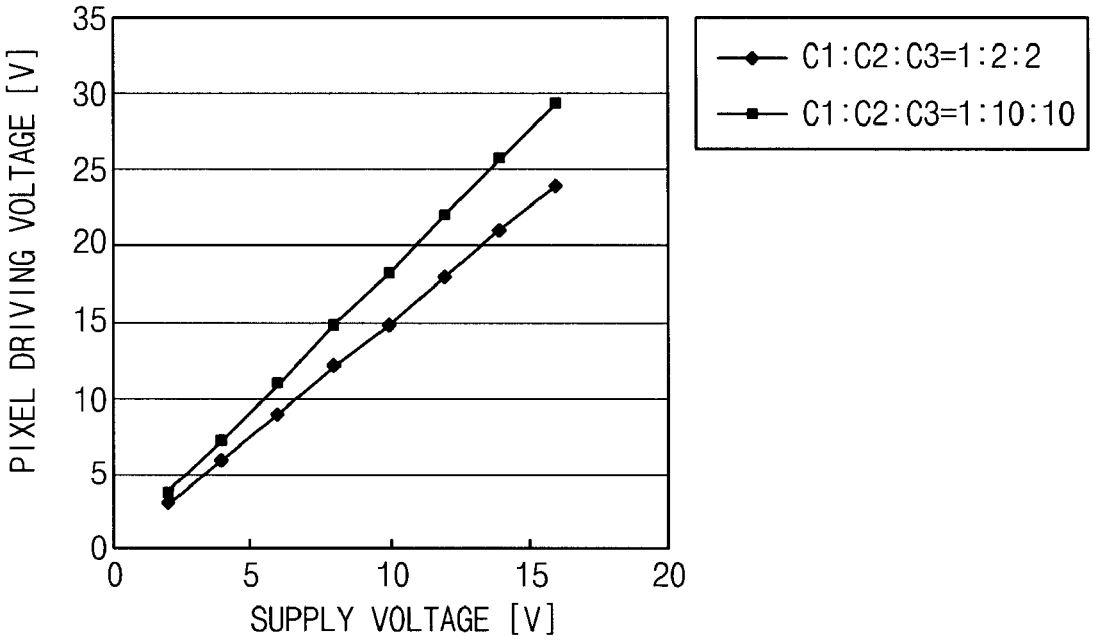
FIG. 5 is a graph showing a relationship between a supply voltage provided to the pixel driving circuit of FIG. 2 and a driving voltage of the pixel driving circuit of FIG. 2.

FIG. 5 is a graph showing a relationship between a supply voltage provided to the pixel driving circuit of FIG. 2 and a driving voltage of the pixel driving circuit of FIG. 2. In FIG. 5, a supply voltage denotes a voltage difference between the first and second data voltages, and a pixel driving voltage denotes a voltage difference between the first and second pixel voltages that are changed.

Referring to FIG. 5, when the supply voltage is about 15 V, it is recognized that the first capacitance C1 should be greater than the second capacitance C2 or the third capacitance C3 by 10 times or more in order for the pixel driving voltage to be about 30 V.

That is, in this exemplary embodiment, when the supply voltage is about 15 V, the ratio of the first, second, and third capacitances C1, C2, and C3 should be about 1:10:10, so that the pixel driving voltage may be about 30 V.

Exemplary Embodiment 2

Figure 6:
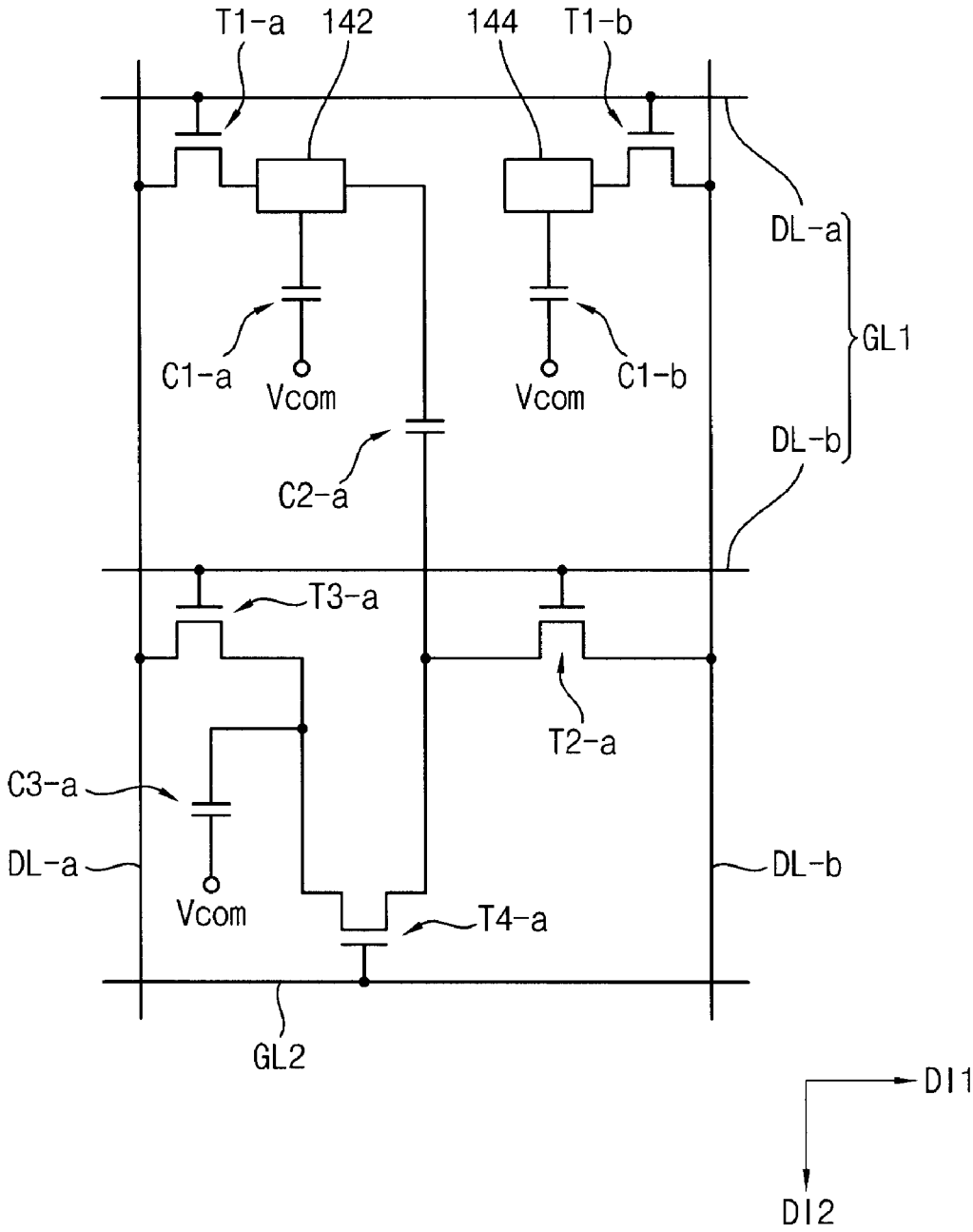
FIG. 6 is a circuit diagram showing a pixel driving circuit of a display apparatus according to Exemplary Embodiment 2 of the present invention.

FIG. 6 is a circuit diagram showing a pixel driving circuit of a display apparatus according to Exemplary Embodiment 2 of the present invention.

A display apparatus according to the present exemplary embodiment is substantially the same as the display apparatus of FIG. 1, FIG. 2, FIG. 3, FIG. 4, and FIG. 5 except for a first gate line. Thus, identical reference numerals are used in FIG. 6 to refer to components that are the same or like those shown in FIG. 1, FIG. 2, FIG. 3, FIG. 4, and FIG. 5, and thus, a detailed description thereof will be omitted.

Referring to FIG. 6, a first gate line GL1 in accordance with the present exemplary embodiment includes a first dividing gate line GL-a and a second dividing gate line GL-b. The first and second dividing gate lines GL-a and GL-b simultaneously transmit a first gate signal.

The first dividing gate line GL-a extends along a first direction DI1. The first dividing gate line GL-a is connected to a gate electrode of the first driving transistor T1-*a* and a gate electrode of the second driving transistor T1-*b*.

The second dividing gate line GL-b extends along the first direction DI1, and is disposed between the first dividing gate line GL-a and the second gate line GL2. For example, the second dividing gate line GL-b may be disposed along a center portion between the first dividing gate line GL-a and the second gate line GL2.

The second dividing gate line GL-b is connected to a gate electrode of the first voltage-supplying transistor T2-*a* and a gate electrode of the first voltage-storing transistor T3-*a*, respectively.

Exemplary Embodiment 3

Figure 7:
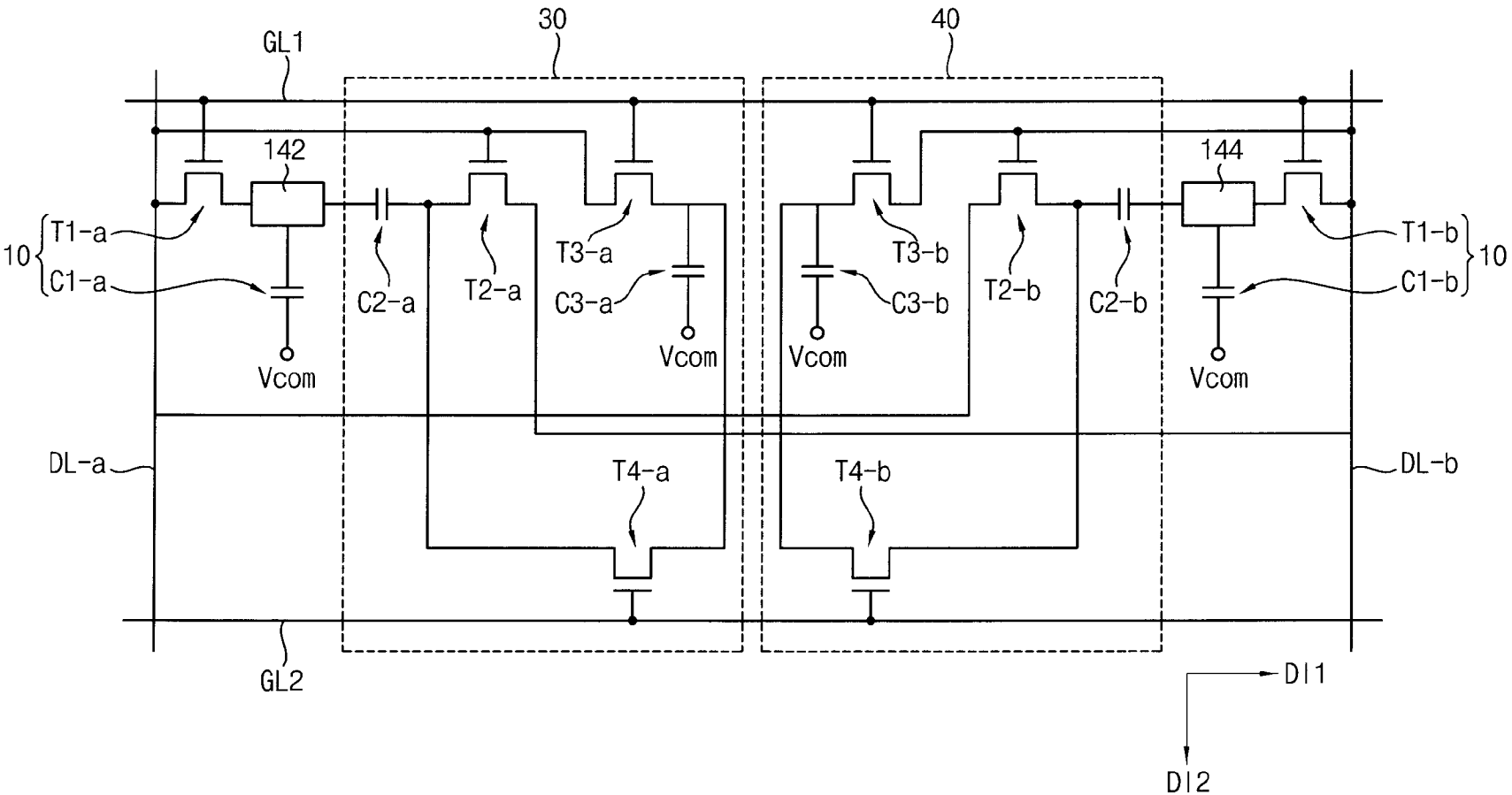
FIG. 7 is a circuit diagram showing a pixel driving circuit of a display apparatus according to Exemplary Embodiment 3 of the present invention.

FIG. 7 is a circuit diagram showing a pixel driving circuit of a display apparatus according to Exemplary Embodiment 3 of the present invention.

A display apparatus according to the present exemplary embodiment is substantially the same as the display apparatus of FIG. 1, FIG. 2, FIG. 3, FIG. 4, and FIG. 5 except for a second voltage-changing part. Thus, identical reference numerals are used in FIG. 7 to refer to components that are the same or like those shown in FIG. 1, FIG. 2, FIG. 3, FIG. 4, and FIG. 5, and thus, a detailed description thereof will be omitted.

Referring to FIG. 7, a pixel driving circuit according to the present exemplary embodiment further includes a second voltage-changing part 40 in comparison with the pixel driving circuit of FIG. 2.

The second voltage-changing part 40 is connected to the second pixel electrode 144, the first data line DL-a, and the second data line DL-b, so that the second voltage-changing part 40 may change the second pixel voltage of the second pixel electrode 144 to increase a voltage difference between the first and second pixel electrodes 142 and 144.

For example, the second voltage-changing part 40 may include a second voltage-supplying transistor T2-*b*, a second voltage-changing capacitor C2-*b*, a second voltage-storing transistor T3-*b*, a third voltage-storing capacitor C3-*b*, and a second voltage-changing transistor T4-*b*.

A gate electrode of the second voltage-supplying transistor T2-*b* is connected to the first gate line GL1, and a source electrode of the second voltage-supplying transistor T2-*b* is connected to the first data line DL-a.

A first electrode of the second voltage-changing capacitor C2-*b* is connected to the second pixel electrode 144, and a second electrode of the second voltage-changing capacitor C2-*b*, which faces the first electrode, is connected to a drain electrode of the second voltage-supplying transistor T2-*b*.

A gate electrode of the second voltage-storing transistor T3-*b* is connected to the first gate line GL1, and a source electrode of the second voltage-storing transistor T3-*a* is connected to the second data line DL-b.

A first electrode of the second voltage-storing capacitor C3-*b* is connected to a drain electrode of the second voltage-storing transistor T3-*b*. A second electrode of the second voltage-storing capacitor C3-*b*, which faces the first electrode of the second voltage-storing capacitor C3-*b*, receives the common voltage Vcom from the common electrode 120.

A gate electrode of the second voltage-changing transistor T4-*b* is connected to the second gate line GL2, and a source electrode of the second voltage-changing transistor T4-*b* is connected to a first electrode of the second voltage-storing capacitor C3-*b*. A drain electrode of the second voltage-changing transistor T4-*b* is connected to a second electrode of the second voltage-changing capacitor C2-*b*.

Hereinafter, a method of driving the pixel driving circuit of FIG. 7 will be described. Here, the driving method of the first voltage-changing part 30 is the same as the driving method as described in FIG. 3 and FIG. 4, so that a driving method of the second voltage-changing part 40 will be described.

Figure 8:
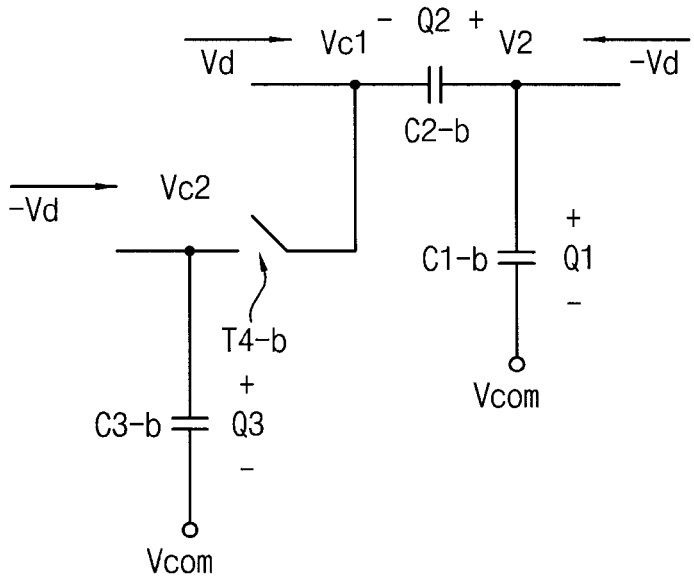
FIG. 8 is a circuit diagram schematically showing the state of a second driving part and a second voltage-changing part when a first gate signal is applied to a first gate line of FIG. 7.

FIG. 8 is a circuit diagram schematically showing the state of a second driving part and a second voltage-changing part when a first gate signal is applied to a first gate line of FIG. 7.

Referring to FIG. 7 and FIG. 8, when the first gate signal is applied to the first gate line GL1, the second driving transistor T1-*b*, the second voltage-supplying transistor T2-*b*, and the second voltage-storing transistor T3-*b* are turned on.

In this exemplary embodiment, the first data voltage may be a positive driving voltage Vd, and the second data voltage may be a negative driving voltage −Vd. When the second driving transistor T1-*b*, the second voltage-supplying transistor T2-*b*, and the second voltage-storing transistor T3-*b* are turned on, the positive driving voltage Vd is applied to the second electrode of the second voltage-changing capacitor C2-*b*, and the negative driving voltage −Vd is applied to the second pixel electrode 144 and a first electrode of the second voltage-storing capacitor C3-*b*.

That is, when the first gate signal is applied to the first gate line GL1, a second pixel voltage V2 of the second pixel electrode 144 is the negative driving voltage −Vd, a first charge voltage Vc1 of a second electrode of the second voltage-changing capacitor C2-*b* is the positive driving voltage Vd, and a second charge voltage Vc2 of a first electrode of the second voltage-storing capacitor C3-*b* is the negative driving voltage −Vd.

That is, when the first gate signal is applied to the first gate line GL1, a first electric charge amount Q1 is charged in the second driving capacitor C1-*b*, and a second electric charge amount Q2 is charged in the second voltage-changing capacitor C2-*b*. Moreover, a third electric charge amount Q3 is charged in the second voltage-storing capacitor C3-*b*.

Here, when the second driving capacitors C1-*b*, the second voltage-changing capacitor C2-*b* and the second voltage-storing capacitor C3-*b* has a first capacitance C1, a second capacitance C2 and a third capacitance C3, respectively, the first, second, and third electric charge amounts Q1, Q2, and Q3 may be obtained by the following Equation 5.

$$Q1=C1\times V2$$

$$Q2=C2\times(V2-Vc1)$$

$$Q3=C3\times Vc2 \qquad \text{Equation 5}$$

Figure 9:
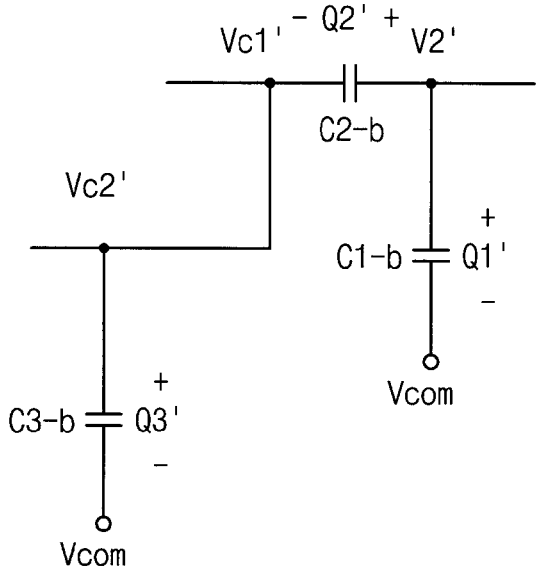
FIG. 9 is a circuit diagram schematically showing the state of a second driving part and a second voltage-changing part when a second gate signal is applied to a second gate line of FIG. 7.

FIG. 9 is a circuit diagram schematically showing the state of a second driving part and a second voltage-changing part when a second gate signal is applied to a second gate line of FIG. 7.

Referring to FIG. 7 and FIG. 9, when the second gate signal is applied to the second gate line GL2, the second voltage-changing transistor T4-*b* is turned on.

When the second voltage-changing transistor T4-*b* is turned on, the first charge voltage Vc1 of a second electrode of the second voltage-changing capacitor C2-*b* and the second charge voltage Vc2 of a first electrode of the second voltage-storing capacitor C3-*b* are mixed with each other to be changed into a medium voltage between the first and second charge voltages Vc1 and Vc2.

That is, the first charge voltage Vc1 may be decreased by a voltage difference between the first charge voltage Vc1 and the medium voltage, and the second charge voltage Vc2 may be increased by a voltage difference between the second charge voltage Vc2 and the medium voltage. Here, the changed first and second charge voltages Vc1' and Vc2' are a medium voltage between the first and second charge voltages Vc1 and Vc2.

When the first charge voltage Vc1 is decreased, the second pixel voltage V2 of the second pixel electrode 144 may be decreased by a decreasing level of the charge voltage Vc1. Thus, the changed second pixel voltage V2' may be smaller than the negative driving voltage −Vd.

As the first pixel voltage V1' that is changed by the first voltage-changing part 30 has a greater voltage than the positive driving voltage Vd, a voltage difference between the first and second pixel voltages that are changed may be greater than a voltage difference between the first and second pixel voltages as described in Exemplary Embodiment 1.

When the second gate signal is applied to the second gate line GL2, the first, second, and third electric charge amounts Q1, Q2, and Q3 that are charged in the second driving capacitor C1-*b*, the second voltage-changing capacitor C2-*b*, and the second voltage-storing capacitor C3-*b*, respectively, may be changed. The changed first, second, and third electric charge amounts Q1', Q2', and Q3' may be obtained by the following Equation 6.

$$Q1'=C1\times V2'$$

$$Q2'=C2\times(V2'-Vc1')$$

$$Q3'=C3\times Vc2' \qquad \text{Equation 6}$$

Referring again to FIG. 8 and FIG. 9, electric charge amounts that are formed in each capacitor due to the conservation law of electrical charge may be obtained by the following Equation 7.

$$Q1+Q2=Q1'+Q2'$$

$$Q3-Q2=Q3'-Q2' \qquad \text{Equation 7}$$

When the changed second pixel voltage V2' is calculated using Equations 5, 6, and 7, the following Equation 8 may be obtained.

$$v2' = -(1+k)\times Vd, \text{ wherein, } K = \frac{\frac{2}{C2}}{\left(\frac{1}{C1}+\frac{1}{C2}+\frac{1}{C3}\right)} \quad \text{Equation 8}$$

Thus, when a voltage difference of the first and second pixel voltages that are changed by using Equations 4 and 8 is calculated, the following Equation 9 may be obtained.

$$V1'-V2'=2(1+K)\times Vd \quad \text{Equation 9}$$

In this exemplary embodiment, when the first voltage-changing part 30 increases the amplitude of the first pixel voltage V1, the second voltage-changing part 40 decreases the amplitude of the second pixel voltage V2. On the other hand, when the first voltage-changing part 30 decreases the amplitude of the first pixel voltage V1, the second voltage-changing part 40 may increase the amplitude of the second pixel voltage V2.

Figure 10:
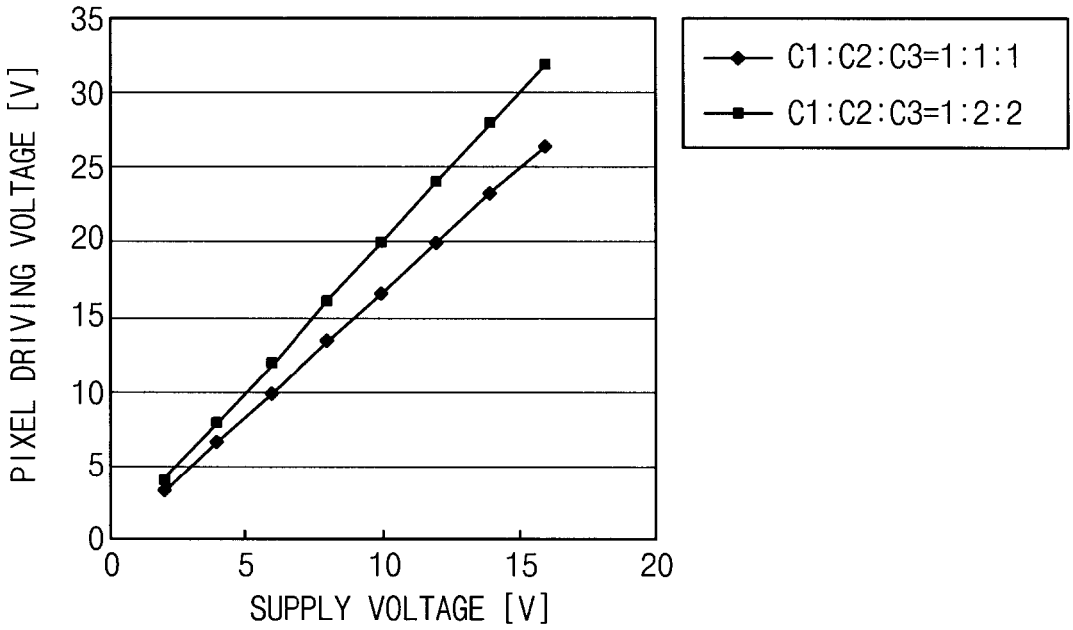
FIG. 10 is a graph showing a relationship between a supply voltage provided to the pixel driving circuit of FIG. 7 and a driving voltage of the pixel driving circuit of FIG. 7.

FIG. 10 is a graph showing a relationship between a supply voltage provided to the pixel driving circuit of FIG. 7 and a driving voltage of the pixel driving circuit of FIG. 7. In FIG. 10, a supply voltage denotes a voltage difference between the first and second data voltages, and a pixel driving voltage denotes a voltage difference between the first and second pixel voltages that are changed.

Referring to FIG. 10, when the supply voltage is about 15 V, the first capacitance C1 should be greater than the second capacitance C2 and the third capacitance C3 by two times or more in order for the pixel driving voltage to be about 30 V.

That is, in third exemplary embodiment, when the ratio of the first, second, and third capacitance C1, C2, and C3 is about 1:2:2, which is less than that of Exemplary Embodiment 1, the pixel driving voltage of about 30 V may be generated through the supply voltage.

Exemplary Embodiment 4

Figure 11:
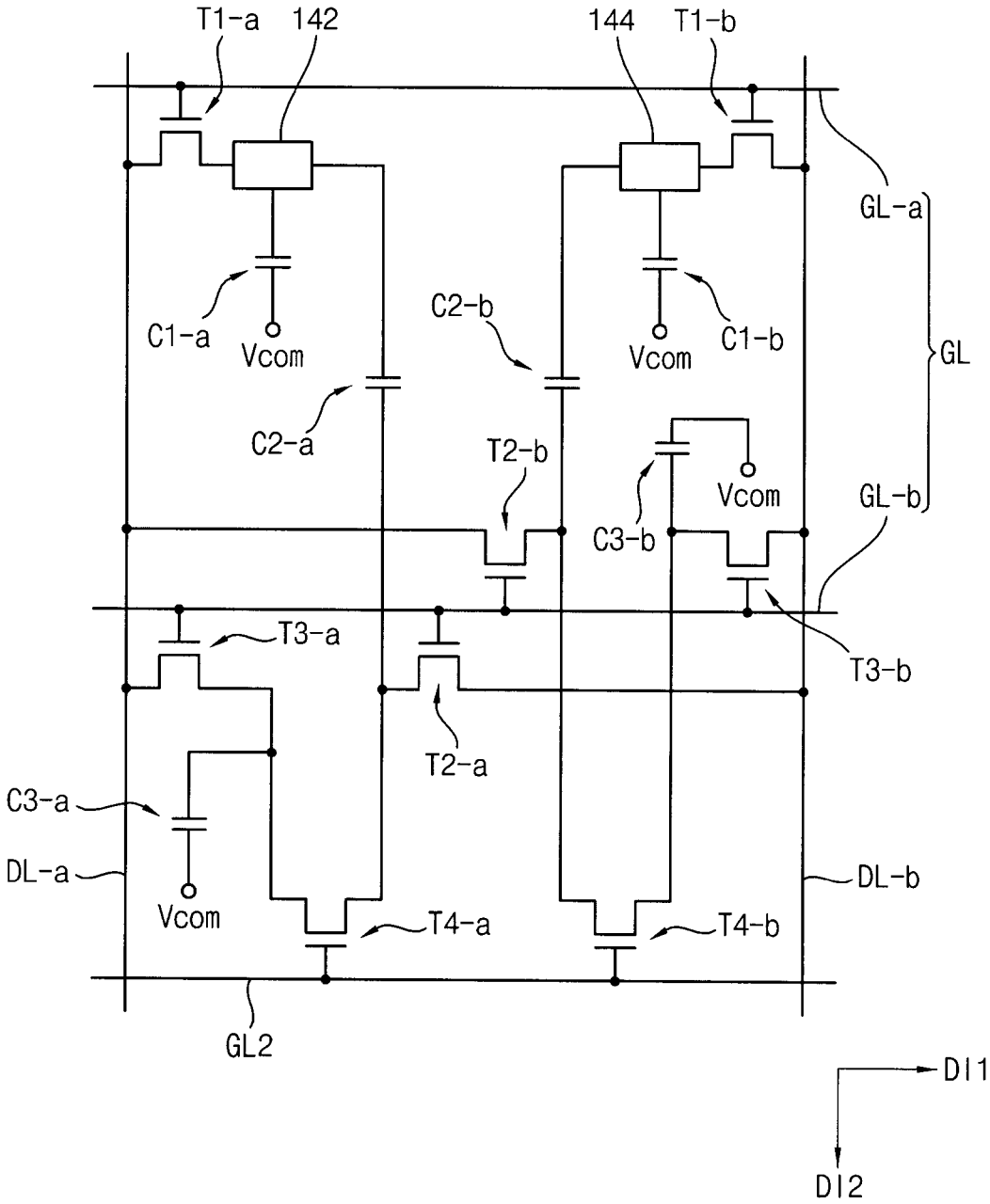
FIG. 11 is a circuit diagram showing a pixel driving circuit of a display apparatus according to Exemplary Embodiment 4 of the present invention.

FIG. 11 is a circuit diagram showing a pixel driving circuit of a display apparatus according to Exemplary Embodiment 4 of the present invention.

A display apparatus according to the present exemplary embodiment is substantially the same as the display apparatus of FIG. 7, FIG. 8, FIG. 9, and FIG. 10 except for a first gate line. Thus, identical reference numerals are used in FIG. 11 to refer to components that are the same or like those shown in FIG. 7, FIG. 8, FIG. 9, and FIG. 10, and thus, a detailed description thereof will be omitted.

Referring to FIG. 11, a first gate line GL1 according to the present exemplary embodiment includes a first dividing gate line GL-a and a second dividing gate line GL-b. The first and second dividing gate lines GL-a, and GL-b simultaneously transmit a first gate signal.

The first dividing gate line GL-a extends along a first direction DI1. The first dividing gate line GL-a is connected to a gate electrode of the first driving transistor T1-*a* and a gate electrode of the second driving transistor T1-*b*, respectively.

The second dividing gate line GL-b extends along the first direction DI1, and is disposed between the first dividing gate line GL-a and the second gate line GL2. For example, the second dividing gate line GL-b may be disposed along a center portion between the first dividing gate line GL-a and the second gate line GL2.

The second dividing gate line GL-b is connected to a gate electrode of the first voltage-supplying transistor T2-*a* and a gate electrode of the first voltage-storing transistor T3-*a*, respectively. The second dividing gate line GL-b is connected to a gate electrode of the second voltage-supplying transistor T2-*b* and a gate electrode of the second voltage-storing transistor T3-*b*, respectively.

According to exemplary embodiments of the present invention, as a first voltage-changing part changes a first pixel voltage of a first pixel electrode or a second voltage-changing part changes a second pixel voltage of a second pixel electrode, a voltage difference between the first and second pixel voltages may be greater than a voltage difference between first and second data voltages that are applied to first and second data lines, respectively.

That is, when the first and second voltage-changing parts are disposed within a pixel driving circuit, a voltage difference between the first and second pixel voltages may be increased even though a voltage-generating part that generates a voltage of a limited range is used.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A pixel driving method, comprising:

applying a first data voltage and a second data voltage to a first pixel electrode and a second pixel electrode, respectively, that are spaced apart from each other, and storing the first and second data voltages in a plurality of capacitors that are connected to the first pixel electrode or the second pixel electrode, when a first gate signal is applied to a first gate line; and changing a first pixel voltage of the first pixel electrode or a second pixel voltage of the second pixel electrode to increase a voltage difference between the first pixel electrode and the second pixel electrode by mixing the first data voltage with the second data voltage stored in the capacitors, when a second gate signal is applied to a second gate line adjacent to the first gate line.

2. The pixel driving method of claim 1, wherein a voltage difference between the first pixel voltage and the second pixel voltage is greater than that between the first data voltage and the second data voltage.

3. The pixel driving method of claim 1, wherein changing the first pixel voltage or the second pixel voltage further comprises:

decreasing the second pixel voltage when the first pixel voltage is increased, and increasing the second pixel voltage when the first pixel voltage is decreased.

4. A pixel driving circuit, comprising:

a first gate line and a second gate line extending along a first direction and being disposed adjacent to each other;

a first data line extending along a second direction crossing the first direction, the first data line to transmit a first data voltage;

a second data line disposed adjacent to the first data line, the second data line to transmit a second data voltage that is different from the first data voltage;

a pixel part disposed within a unit pixel, the pixel part comprising a first pixel electrode and a second pixel electrode that are spaced apart from each other;

a first driving part connected to the first data line and the first pixel electrode, the first driving part to apply the first data voltage to the first pixel electrode;

a second driving part connected to the second data line and the second pixel electrode, the second driving part to apply the second data voltage to the second pixel electrode; and a first voltage-changing part connected to the first pixel electrode, the first data line, and the second data line, the first voltage-changing part to change a first pixel voltage of the first pixel electrode to increase a voltage difference between the first pixel electrode and the second pixel electrode.

5. The pixel driving circuit of claim 4, wherein the first driving part comprises:

a first driving transistor comprising a gate electrode connected to the first gate line, a source electrode connected to the first data line, and a drain electrode connected to the first pixel electrode; and a first driving capacitor comprising a first electrode connected to the first pixel electrode, and a second electrode facing the first electrode to receive a common voltage.

6. The pixel driving circuit of claim 5, wherein the first voltage-changing part comprises:

a first voltage-supplying transistor comprising a gate electrode connected to the first gate line, and a source electrode connected to the second data line;

a first voltage-changing capacitor comprising a first electrode connected to the first pixel electrode, and a second electrode facing the first electrode, the second electrode being connected to a drain electrode of the first voltage-supplying transistor;

a first voltage-storing transistor comprising a gate electrode connected to the first gate line, and a source electrode connected to the first data line;

a first voltage-storing capacitor comprising a first electrode connected to a drain electrode of the first voltage-storing transistor, and a second electrode facing the first electrode, the second electrode to receive the common voltage; and a first voltage-changing transistor comprising a gate electrode connected to the second gate line, a source electrode connected to the first electrode of the first voltage-storing capacitor, and a drain electrode connected to the second electrode of the first voltage-changing capacitor.

7. The pixel driving circuit of claim 6, wherein the first gate line comprises:

a first dividing gate line connected to the gate electrode of the first driving transistor; and a second dividing gate line disposed between the first dividing gate line and the second gate line to simultaneously transmit a gate signal that is the same as a gate signal transmitted by the first dividing gate line, the second dividing gate line being connected to the gate electrode of the first voltage-supplying transistor and the gate electrode of the first voltage-storing transistor.

8. The pixel driving circuit of claim 4, further comprising a second voltage-changing part connected to the second pixel electrode, the first data line, and the second data line, the second voltage-changing part to change a second pixel voltage of the second pixel electrode to increase the voltage difference between the first pixel electrode and the second pixel electrode.

9. The pixel driving circuit of claim 8, wherein the second driving part comprises:

a second driving transistor comprising a gate electrode connected to the first gate line, a source electrode connected to the second data line, and a drain electrode connected to the second pixel electrode; and a second driving capacitor comprising a first electrode connected to the second pixel electrode, and a second electrode facing the first electrode, the second electrode to receive a common voltage.

10. The pixel driving circuit of claim 9, wherein the second voltage-changing part comprises:

a second voltage-supplying transistor comprising a gate electrode connected to the first gate line, and a source electrode connected to the first data line;

a second voltage-changing capacitor comprising a first electrode connected to the second pixel electrode, and a second electrode facing the first electrode, the second electrode being connected to a drain electrode of the second voltage-supplying transistor;

a second voltage-storing transistor comprising a gate electrode connected to the first gate line, and a source electrode connected to the second data line;

a second voltage-storing capacitor comprising a first electrode connected to a drain electrode of the second voltage-storing transistor, and a second electrode facing the first electrode, the second electrode to receive the common voltage; and a second voltage-changing transistor comprising a gate electrode connected to the second gate line, a source electrode connected to the first electrode of the second voltage-storing capacitor, and a drain electrode connected to the second electrode of the second voltage-changing capacitor.

11. The pixel driving circuit of claim 10, wherein the first gate line comprises:

a first dividing gate line connected to a gate electrode of the second driving transistor; and a second dividing gate line disposed between the first dividing gate line and the second gate line to simultaneously transmit a gate signal that is the same as a gate signal transmitted by the first dividing gate line, the second dividing gate line being connected to the gate electrode of the second voltage-supplying transistor and the gate electrode of the second voltage-storing transistor.

12. The pixel driving circuit of claim 8, wherein the second voltage-changing part decreases the level of the second pixel voltage when the first voltage-changing part increases the level of the first pixel voltage, and the second voltage-changing part increases the level of the second pixel voltage when the first voltage-changing part decreases the level of the first pixel voltage.

13. The pixel driving circuit of claim 4, wherein the polarity of the first data voltage is different from that of the second data voltage with respect to the common voltage.

14. The pixel driving circuit of claim 13, wherein a voltage difference between the changed first pixel voltage and the second pixel voltage is greater than that between the first data voltage and the second data voltage.

15. A display apparatus, comprising:

a first substrate having a pixel driving circuit disposed on a base substrate;

a second substrate facing the first substrate; and a liquid crystal layer disposed between the first substrate and the second substrate, wherein the pixel driving circuit comprises:

a first gate line and a second gate line extending along a first direction and disposed adjacent to each other;

a first data line extending along a second direction crossing the first direction, the first data line to transmit a first data voltage;

a second data line disposed adjacent to the first data line, the second data line to transmit a second data voltage that is different from the first data voltage;

a pixel part disposed within a unit pixel, the pixel part comprising a first pixel electrode and a second pixel electrode that are spaced apart from each other;

a first driving part connected to the first data line and the first pixel electrode, the first driving part to apply the first data voltage to the first pixel electrode;

a second driving part connected to the second data line and the second pixel electrode, the second driving part to apply the second data voltage to the second pixel electrode; and a first voltage-changing part connected to the first pixel electrode, the first data line, and the second data line, the first voltage-changing part to change a first pixel voltage of the first pixel electrode to increase a voltage difference between the first pixel electrode and the second pixel electrode.

16. The display apparatus of claim 15, wherein the first pixel electrode and the second pixel electrode each comprise a patterned transparent metal layer.

17. The display apparatus of claim 16, wherein the first pixel electrode and the second pixel electrode each have a comb shape that is disposed in a zigzag pattern.

18. The display apparatus of claim 16, wherein the first substrate comprises a common electrode disposed between the first pixel electrode and the second pixel electrode and the base substrate to apply a common voltage to the first driving part, the second driving part, and the first voltage-changing part.

19. The display apparatus of claim 15, wherein the first driving part comprises:

a first driving transistor comprising a gate electrode connected to the first gate line, a source electrode connected to the first data line, and a drain electrode connected to the first pixel electrode; and a first driving capacitor comprising a first electrode connected to the first pixel electrode, and a second electrode facing the first electrode to receive a common voltage, the second driving part comprising:

a second driving transistor comprising a gate electrode connected to the first gate line, a source electrode connected to the second data line, and a drain electrode connected to the second pixel electrode; and a second driving capacitor comprising a first electrode connected to the second pixel electrode, and a second electrode facing the first electrode to receive a common voltage, and the first voltage-changing part comprising:

a first voltage-supplying transistor comprising a gate electrode connected to the first gate line, and a source electrode connected to the second data line;

a first voltage-changing capacitor comprising a first electrode connected to the first pixel electrode, and a second electrode facing the first electrode the second electrode being connected to a drain electrode of the first voltage-supplying transistor;

a first voltage-storing transistor comprising a gate electrode connected to the first gate line, and a source electrode connected to the first data line;

a first voltage-storing capacitor comprising a first electrode connected to a drain electrode of the first voltage-storing transistor, and a second electrode facing the first electrode to receive the common voltage; and a first voltage-changing transistor comprising a gate electrode connected to the second gate line, a source electrode connected to the first electrode of the first voltage-storing capacitor, and a drain electrode connected to the second electrode of the first voltage-changing capacitor.

20. The display apparatus of claim 19, wherein the pixel driving circuit further comprises a second voltage-changing part connected to the second pixel electrode, the first data line, and the second data line, the second voltage-changing part to change a second pixel voltage of the second pixel electrode to increase a voltage difference between the first pixel electrode and the second pixel electrode, and the second voltage-changing part comprises:

a second voltage-supplying transistor comprising a gate electrode connected to the first gate line, and a source electrode connected to the first data line;

a second voltage-changing capacitor comprising a first electrode connected to the second pixel electrode, and a second electrode facing the first electrode, the second electrode being connected to a drain electrode of the second voltage-supplying transistor;

a second voltage-storing transistor comprising a gate electrode connected to the first gate line, and a source electrode connected to the second data line;

a second voltage-storing capacitor comprising a first electrode connected to a drain electrode of the second voltage-storing transistor, and a second electrode facing the first electrode to receive the common voltage; and a second voltage-changing transistor comprising a gate electrode connected to the second gate line, a source electrode connected to the first electrode of the second voltage-storing capacitor, and a drain electrode connected to the second electrode of the second voltage-changing capacitor.

21. The display apparatus of claim 15, wherein the first and second substrates have flexible characteristics.

22. The display apparatus of claim 21, wherein the liquid crystal layer comprises a blue phase liquid crystal.

* * * * *